US007837479B1

(12) United States Patent
Millard et al.

(10) Patent No.: US 7,837,479 B1
(45) Date of Patent: Nov. 23, 2010

(54) MEZZANINE CONNECTOR ASSEMBLY HAVING COATED CONTACTS

(75) Inventors: Steven J. Millard, Mechanicsburg, PA (US); Juli S. Olenick, Lake Worth, FL (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/504,452

(22) Filed: Jul. 16, 2009

(51) Int. Cl.
*H01R 12/00* (2006.01)

(52) U.S. Cl. ..... 439/74; 439/75

(58) Field of Classification Search ..... None
See application file for complete search history.

(56) References Cited

U.S. PATENT DOCUMENTS 3,840,841 A * 10/1974 Clark ..... 439/589
4,283,754 A * 8/1981 Parks ..... 361/703
4,606,603 A * 8/1986 Cairns ..... 385/58
4,662,703 A * 5/1987 Forney et al. ..... 439/578
4,666,230 A * 5/1987 Gartzke ..... 439/578
4,913,673 A * 4/1990 Kobler ..... 439/736
5,203,721 A * 4/1993 Buck ..... 439/581
5,340,319 A * 8/1994 Enomoto et al. ..... 439/75
5,400,504 A 3/1995 Neumann et al.
5,704,794 A * 1/1998 Lindeman ..... 439/66
5,782,645 A * 7/1998 Stobie et al. ..... 439/289
6,866,521 B1 * 3/2005 Harper, Jr. ..... 439/71
6,927,343 B2 * 8/2005 Watanabe et al. ..... 174/254
7,090,501 B1 8/2006 Scherer et al.
2003/0199181 A1 * 10/2003 Chou et al. ..... 439/74
2009/0186495 A1 * 7/2009 Taylor ..... 439/66

* cited by examiner

*Primary Examiner*—Michael C Zarroli

(57) ABSTRACT

A mezzanine connector assembly is configured to electrically interconnect first and second circuit boards. The connector assembly includes a mounting body, a mating body, contacts and dielectric layers. The mounting body is configured to be mounted to the first circuit board. The mating body is disposed opposite of the mounting body and is configured to mate with the second circuit board. The mating body is separated from the mounting body by a separation gap along a vertical direction. The contacts extend between the mounting body and the mating body along the vertical direction. The contacts are configured to be coupled with the first and second circuit boards to electrically join the first and second circuit boards. The dielectric layers discretely surround corresponding ones of the contacts in the separation gap between the mounting body and the mating body. The dielectric layers are separated from one another by an air gap in the separation gap.

19 Claims, 3 Drawing Sheets

MEZZANINE CONNECTOR ASSEMBLY HAVING COATED CONTACTS

BACKGROUND OF THE INVENTION

The invention relates generally to electrical connectors and, more particularly, to a connector assembly that mechanically and electrically connects circuit boards.

Known mezzanine connectors mechanically and electrically connect circuit boards. With some known mezzanine connectors, the mezzanine connectors may be mounted to one circuit board and a mating connector is mounted to another circuit board. The mezzanine connector and the mating connector mate with one another to mechanically and electrically interconnect the circuit boards. Contacts in the mezzanine connector mate with one of the circuit boards and with contacts in the mating connector to provide electrical connections between the circuit boards.

Some known mezzanine connectors communicate differential signals at relatively high data rates between the circuit boards. For example, the connectors may include at least two signal contacts that communicate the differential signals and several ground contacts that are electrically coupled to a ground reference. The ground contacts may shield the signal contacts from electromagnetic interference to improve the integrity of the differential signals communicated via the signal contacts.

In order to reduce electrical impedance characteristics of the signal contacts, the signal and ground contacts may be located closer together in the mezzanine connector. For example, the ground contacts may be located in the mezzanine connector in positions that are relatively close to the signal contacts to increase the amount of electromagnetic interference that is shielded from the signal contacts. Due to tooling and manufacturing tolerances involved in the manufacture of the mezzanine connectors, however, the signal and ground contacts may not be able to be located closer than a minimum distance. For example, the tools involved in cutting openings in the mezzanine connector in which the signal and ground contacts are held may be limited in how closely the signal contact openings can be positioned to the ground contact openings. Consequently, some known connectors include solid masses or blocks of dielectric material that extend throughout the connectors. The ground and signal contacts are held in the same block of dielectric material. But, the relatively large amount of dielectric material in the connectors may increase the cost of manufacturing the connectors. Additionally, changes in temperature may result in thermal stresses causing cracks and other failures in the connectors due to mismatches between the coefficients of thermal expansion between the dielectric material, the contacts, and other components of the connectors.

Thus, a need exists for connectors that reduce electrical impedance characteristics of contacts in the connectors while avoiding or reducing the impact of some of the above problems in known connectors.

BRIEF DESCRIPTION OF THE INVENTION

In one embodiment, a mezzanine connector assembly is provided. The connector assembly is configured to electrically interconnect first and second circuit boards. The connector assembly includes a mounting body, a mating body, contacts and dielectric layers. The mounting body is configured to be mounted to the first circuit board. The mating body is disposed opposite of the mounting body and is configured to mate with the second circuit board. The mating body is separated from the mounting body by a separation gap along a vertical direction. The contacts extend between the mounting body and the mating body along the vertical direction. The contacts are configured to be coupled with the first and second circuit boards to electrically join the first and second circuit boards. The dielectric layers discretely surround corresponding ones of the contacts in the separation gap between the mounting body and the mating body. The dielectric layers are separated from one another by an air gap in the separation gap.

In another embodiment, a connector assembly is provided. The connector assembly includes a mounting body, a mating body, contacts and dielectric layers. The mounting body is configured to be mounted to a first circuit board. The mating body is disposed opposite of the mounting body and is configured to mate with a second circuit board to orient the first and second circuit boards in a parallel relationship and separated from one another by a separation gap. The contacts extend between the mounting body and the mating body. The contacts are configured to electrically interconnect the first and second circuit boards. The dielectric layers circumferentially surround corresponding ones of the contacts in the separation gap between the mounting body and the mating body. Each of the contacts is individually coated with a corresponding one of the dielectric layers along respective lengths of the contacts that extend between the mounting body and the mating body.

DETAILED DESCRIPTION OF THE INVENTION

Figure 1:
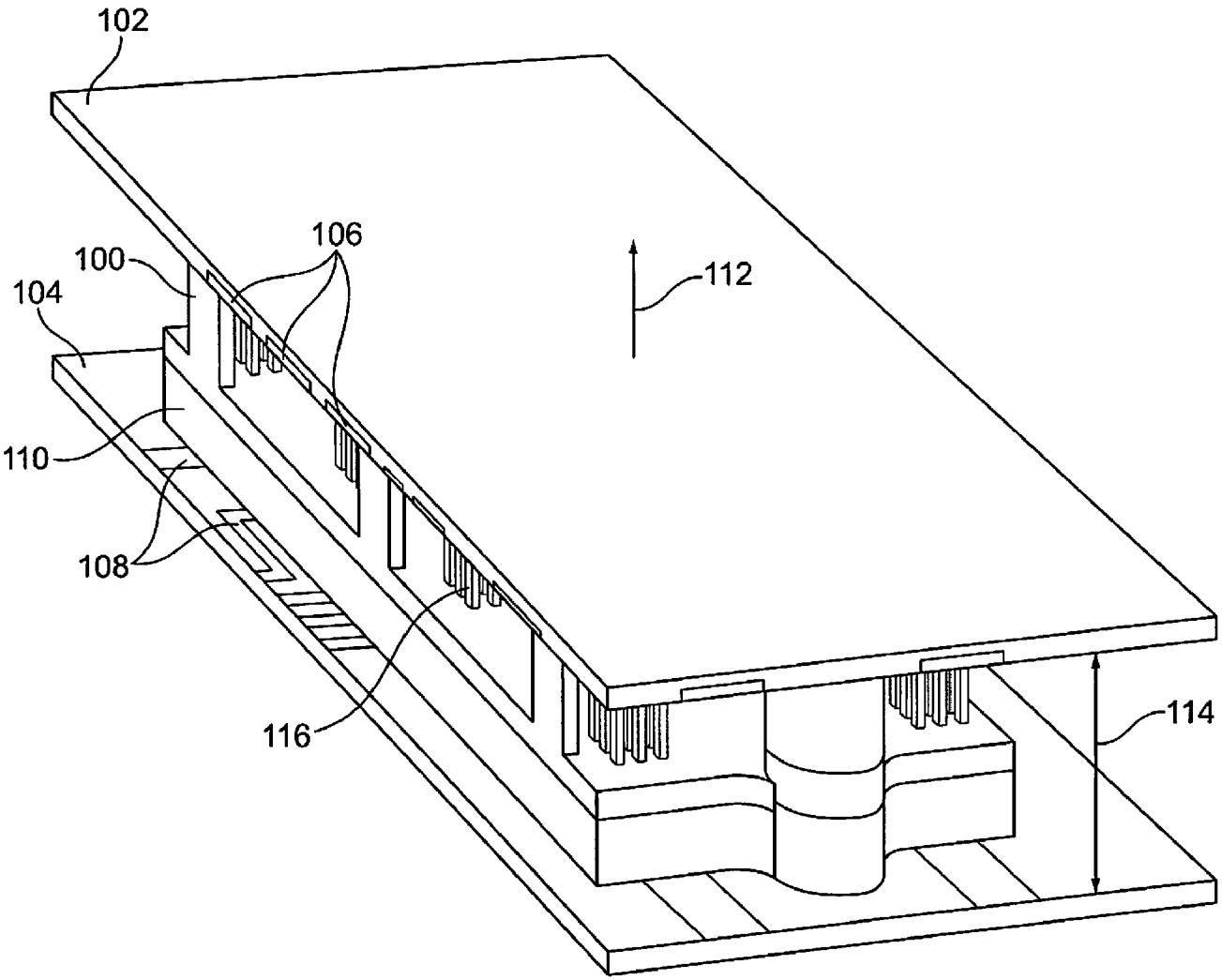
FIG. 1 is a perspective view of a mezzanine connector assembly in accordance with one embodiment.

FIG. 1 is a perspective view of a mezzanine connector assembly 100 in accordance with one embodiment. The connector assembly 100 mechanically and electrically connects a plurality of circuit boards 102, 104 in a parallel arrangement. For example, the connector assembly 100 may interconnect the circuit boards 102, 104 and hold the circuit boards 102, 104 substantially parallel to one another. The circuit boards 102, 104 include conductive pathways 106, 108, respectively. The conductive pathways 106, 108 communicate data and/or power signals within the corresponding circuit board 102, 104. In the illustrated embodiment, the connector assembly 100 is mounted to the circuit board 102 and a mating connector 110 is mounted to the circuit board 104. The connector assembly 100 mates with the mating connector 110 to also mate with the circuit board 104 and thereby electrically and mechanically couple the circuit boards 102, 104. Alternatively, the connector assembly 100 directly mates with both of the circuit boards 102, 104 without mating with the mating connector 110. The connector assembly 100 separates the circuit boards 102, 104 from one another along a vertical direction 112 by a stack height 114. The vertical direction 112 is oriented substantially perpendicular to the circuit boards 102, 104.

The connector assembly 100 includes contacts 116 that vertically extend through the connector assembly 100 between the circuit boards 102, 104. The contacts 116 engage or are otherwise electrically joined with the circuit boards 102, 104 to provide conductive pathways between the circuit boards 102, 104 and through the connector assembly 100. In the illustrated embodiment, the contacts 116 are elongated bodies oriented in directions along, or parallel to, the vertical direction 112.

Figure 2:
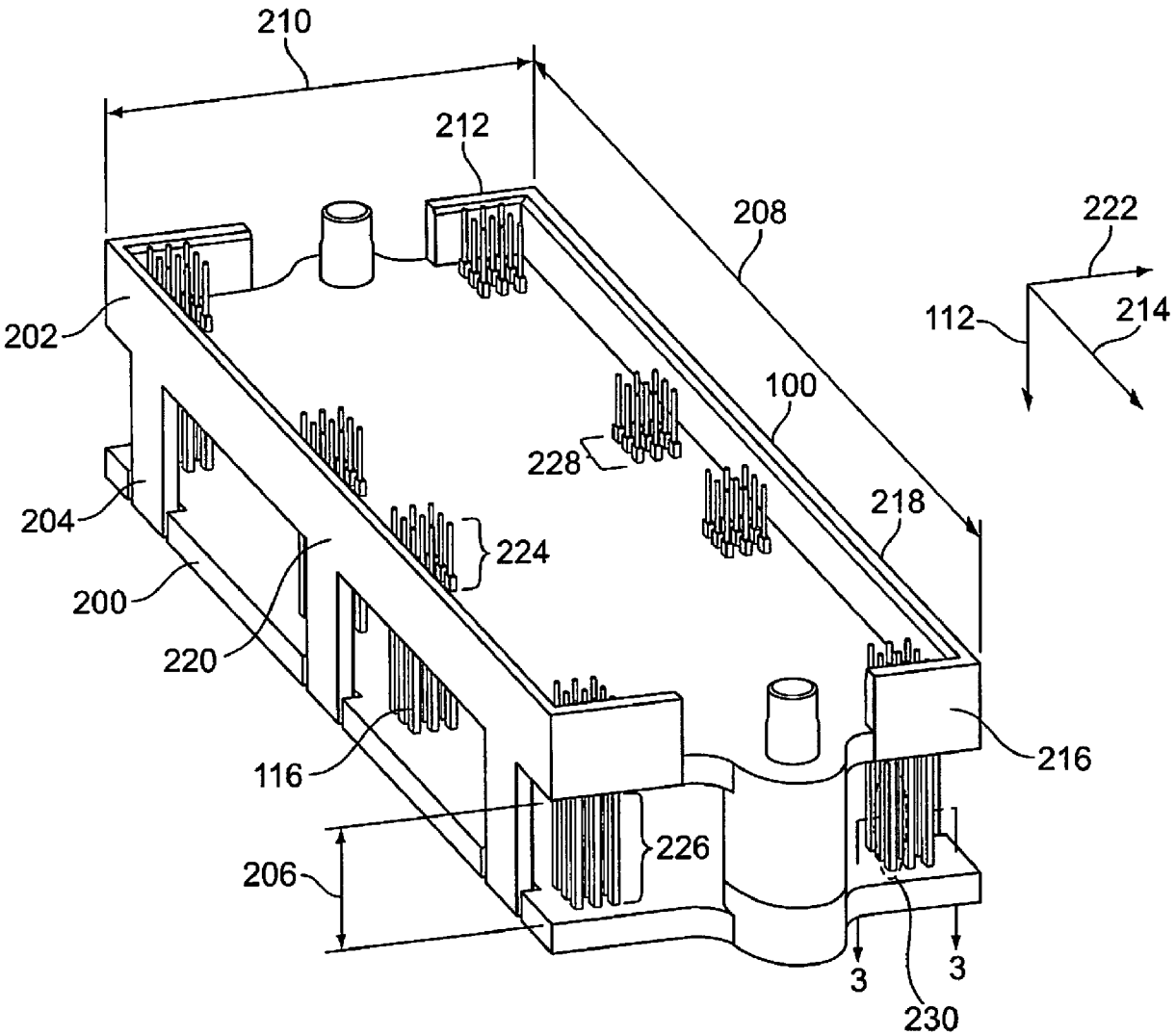
FIG. 2 is a perspective view of the connector assembly shown in FIG. 1 in accordance with one embodiment.

FIG. 2 is a perspective view of the connector assembly 100 in accordance with one embodiment. The connector assembly 100 includes a mounting body 200 and a mating body 202 disposed opposite one another. The mounting body 200 and mating body 202 may include, or be formed from, one or more dielectric materials. For example, the mounting and mating bodies 200, 202 may be molded from one or more polymers. In the illustrated embodiment, the mating body 202 includes several separation arms 204 that extend from the mating body 202 to the mounting body 200 in directions along the vertical direction 112. The separation arms 204 couple the mating body 202 with the mounting body 200 while maintaining separation between the mating body 202 and mounting body 200. For example, in the illustrated embodiment, the mounting body 200 and mating body 202 are separated from one another by a separation gap 206 along the vertical direction 112.

The mounting body 200 and mating body 202 may be separated by the separation gap 206 along an outer length dimension 208 and an outer width dimension 210 of the connector assembly 100. The outer length dimension 208 is measured from one end 212 to an opposite end 216 of the connector assembly 100 in a longitudinal direction 214 while the outer width dimension 210 is measured from one side 218 to an opposite side 220 of the connector assembly 100 in a lateral direction 222. The vertical, longitudinal and lateral directions 112, 214, 222 are perpendicularly oriented with respect to one another in the illustrated embodiment. The separation gap 206 provides a pathway between the mounting and mating bodies 200, 202 for airflow to pass through the connector assembly 100. For example, air may flow through the connector assembly 100 and between the mounting and mating bodies 200, 202 from one end 212 to the opposite end 216 and/or from one side 218 to the opposite side 220. Thermal energy, or heat, may be generated inside the connector assembly 100 as the contacts 116 communicates electric power between the circuit boards 102, 104 (shown in FIG. 1). In order to dissipate the thermal energy, the separation gap 206 permits airflow through the connector assembly 100 and between the mounting and mating bodies 200, 202.

The contacts 116 are arranged in groups 228 in the illustrated embodiment. Alternatively, the contacts 116 may be arranged in a different number of groups 228 or in a single group 228 that extends throughout the length and width dimensions 208, 210 of the connector assembly 100. The contacts 116 are elongated and oriented along the vertical direction 112. The contacts 116 may protrude from one or more of the mating and mounting bodies 202, 200 such that protruding portions 224 on opposite ends of the contacts 116 may be received in one or more of the circuit boards 102, 104 (shown in FIG. 1) and/or the mating connector 110 (shown in FIG. 1). The contacts 116 include gap portions 226 that are sections of the contacts 116 that extend between the mating and mounting bodies 202, 200 in the separation gap 206. In one embodiment, the gap portions 226 include lengths 230 of the contacts 116 that extend from the mating body 202 to the mounting body 200. As described below, the gap portions 226 of the contacts 116 may be individually coated with one or more dielectric layers 300 (shown in FIG. 3) to control an electrical differential impedance characteristic of the contacts 116 and/or the connector assembly 100.

Figure 3:
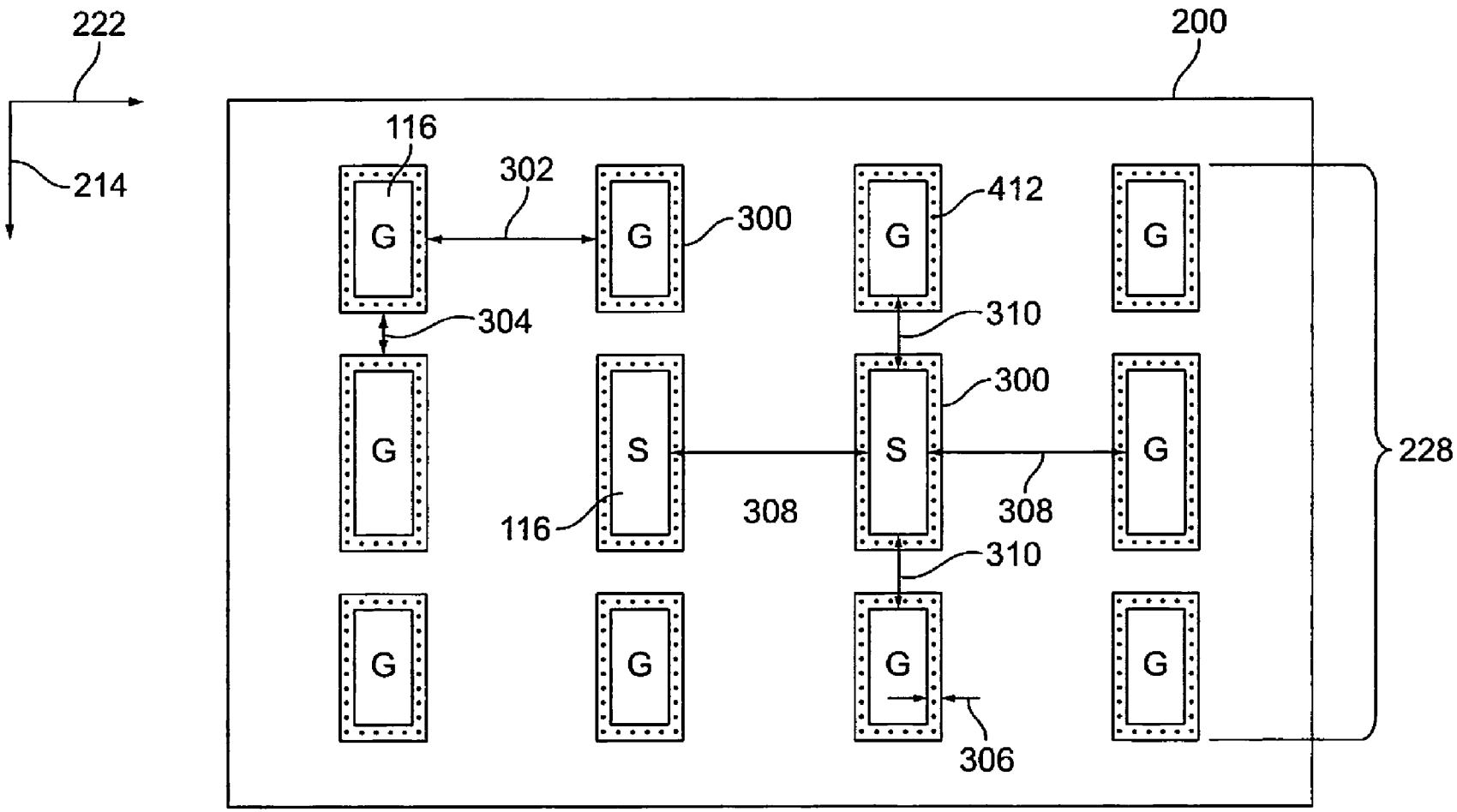
FIG. 3 is a cross-sectional schematic view of a group of contacts shown in FIG. 1 taken along line 3-3 in FIG. 2 in accordance with one embodiment.

FIG. 3 is a cross-sectional schematic view of one of the groups 228 of contacts 116 taken along line 3-3 in FIG. 2 in accordance with one embodiment. The arrangement of contacts 116 in the group 228 shown in FIG. 3 is provided as a non-limiting example. Other arrangements of the contacts 116 may be within the scope of one or more embodiments described herein. Additionally, the rectangular shapes of the contacts 116 shown in FIG. 3 are provided as a schematic representation of the cross-sectional shape of the contacts 116. Different shapes and/or dimensions of the contacts 116 may be within the scope of one or more embodiments described herein. The contacts 116 are labeled with a "G" or an "S" in the illustrated embodiment. The contacts 116 labeled with a "G" are grounding contacts 116 that are electrically coupled with the electric ground reference of one or more of the circuit boards 102, 104 (shown in FIG. 1). The contacts 116 labeled with an "S" are signal contacts 116 that communicate data signals between the circuit boards 102, 104. In one embodiment, the two signal contacts 116 shown in FIG. 3 communicate differential signals through the connector assembly 100 (shown in FIG. 1). The arrangement of grounding and signal contacts 116 may be varied from the arrangement shown in FIG. 3.

The contacts 116 include, or are formed from, one or more conductive materials. For example, the contacts 116 may be machined from a metal block or stamped and formed from sheets of metal. The contacts 116 include dielectric layers 300 that circumferentially surround the exterior surfaces of the contacts 116. The dielectric layers 300 include, or are formed from, one or more electrically insulative materials. For example, the dielectric layers 300 may be formed as an epoxy layer that circumferentially surrounds the contacts 116 along the length 230 (shown in FIG. 2) of the contacts 116. The dielectric layers 300 may enclose the contacts 116 along the length 230 of contacts 116 in the gap portions 226 (shown in FIG. 2) of the contacts 116. In one embodiment, the dielectric layers 300 are provided as electrically insulative coatings on the contacts 116 that extend between the mating body 202 (shown in FIG. 2) and the mounting body 200 in the separation gap 206 (shown in FIG. 2).

The dielectric layers 300 may be provided as individual layers for each of the contacts 116. For example, as shown in FIG. 3, each contact 116 may include a dielectric layer 300 that is separate from the dielectric layers 300 of the adjacent, or nearest neighbor, contacts 116. In one embodiment, the dielectric layers 300 discretely enclose the gap portions 226 (shown in FIG. 2) of the contacts 116 while being noncontinuous with respect to one another. For example, the dielectric layer 300 of one contact 116 may not be continuous with the dielectric layer 300 of another contact 116. While one or more of the contacts 116 may have several dielectric layers 300, the dielectric layers 300 of one contact 116 may not extend into or be coupled or joined with the dielectric layer or layers 300 of another contact 116. The dielectric layer 300 of each contact 116 may be discrete and separated from the dielectric layers 300 of the other contacts 116. For example, each of the contacts 116 may be individually coated with one of the dielectric layers 300 along the length 230 (shown in FIG. 2) of the contact 116 that includes the gap portion 226 (shown in FIG. 2) of the contact 116.

The dielectric layers 300 of adjacent or nearest neighbor contacts 116 may be separated by air gaps 302, 304. The air gaps 302, 304 represent spatial separation between the dielectric layers 300 of adjacent or nearest neighbor contacts 116 in the separation gap 206 (shown in FIG. 2) of the connector assembly 100 (shown in FIG. 1). In one embodiment, the air gap 302 represents the separation distance between adjacent contacts 116 along the lateral direction 222 and the air gap 304 represents the separation dimension between adjacent contacts 116 along the longitudinal direction 214. One or more of the air gaps 302, 304 may be approximately constant along the gap portions 226 (shown in FIG. 2) of the contacts 116. For example, the dielectric layers 300 of adjacent contacts 116 may be separated by at least one or more of the air gaps 302, 304 throughout the separation gap 206 between the mating and mounting bodies 202, 200 (shown in FIG. 2) of the connector assembly 100. As described above, air may flow through the connector assembly 100 and between the mating and mounting bodies 202, 200 due to the separation gap 206 in the connector assembly 100. The separation of the dielectric layers 300 of adjacent contacts 116 from one another also may permit the air to flow between the contacts 116 and through the air gaps 302, 304 in the separation gap 206.

The dielectric layers 300 may be provided about the contacts 116 by applying electrically insulative particles 412 onto the exterior surfaces of the contacts 116 in the separation gap 206 (shown in FIG. 2). For example, the dielectric layers 300 may be formed by spraying, sputtering, depositing or otherwise adhering dielectric particles 412 onto the contacts 116. In one embodiment, the dielectric layers 300 are formed by spraying an epoxy onto the contacts 116 in the separation gap 206. In another example, the dielectric layers 300 may be formed by dipping the contacts 116 into a bath or other container that includes a fluid comprising a dielectric material. The protruding portions 224 (shown in FIG. 2) and any other portions where the dielectric layers 300 are not desired may be masked off prior to spraying the remaining exposed portions of the contacts 116 with a dielectric material or dipping the exposed portions of the contacts 116 into a bath that includes the dielectric material.

Alternatively, the dielectric layers 300 may be provided on the contacts 116 by adhering electrically insulative films to the exterior surfaces of the contacts 116. For example, the dielectric layers 300 may be polyimide films that are joined to the contacts 116 along the length 230 (shown in FIG. 2) of the contacts 116 disposed in the separation gap 206 (shown in FIG. 2).

Providing the dielectric layers 300 as individual layers on the gap portions 226 (shown in FIG. 2) of the contacts 116 may reduce the amount of dielectric material that is used to enclose the contacts 116 in dielectric material in the separation gap 206 (shown in FIG. 2). For example, instead of enclosing all or substantially all of the space in the separation gap 206 between the mating body 202 (shown in FIG. 2) and the mounting body 200 in a block of dielectric material that does not permit air to flow through the separation gap 206, the individual dielectric layers 300 may require less dielectric material to produce and permit air to flow through the separation gap 206.

A thickness dimension 306 of the dielectric layers 300 may be varied. The thickness dimension 306 of the dielectric layers 300 may be varied among the contacts 116 in a group 228 or may be approximately the same for all contacts 116 in a group 228. In one embodiment, the thickness dimension 306 is approximately 1 mil, or 0.0254 millimeters. Alternatively, the dielectric layers 300 are provided in a different thickness dimension 306. Varying the thickness dimension 306 of the dielectric layers 300 may change a differential electrical impedance characteristic of the contacts 116. For example, an electrical impedance characteristic of a signal contact 116 may be based on one or more separation dimensions 308, 310 between the signal contact 116 and the ground contacts 116 that surround a perimeter of the signal contact 116. The separation dimensions 308, 310 may be the smallest distances between the signal contact 116 and the nearest neighbor ground contacts 116 in directions perpendicularly oriented with respect to the vertical direction 112 (shown in FIG. 1). For example, the separation dimensions 308, 310 may be the smallest distances between the signal contact 116 and each of the closest ground contacts 116 along the lateral direction 222 and the longitudinal direction 214, respectively. Increasing the separation dimension 308 and/or 310 between the signal contact 116 and ground contacts 116 surrounding the signal contact 116 may increase the electrical impedance characteristic of the signal contact 116.

In order to decrease the electrical impedance characteristic, the ground contacts 116 may be located closer to the signal contact 116. Tooling or manufacturing tolerances in the manufacture of the connector assembly 100 (shown in FIG. 1) may limit how closely the ground contacts 116 and signal contacts 116 may be located with respect to one another. To further reduce the electrical impedance characteristic of the signal contact 116, the dielectric layers 300 of the ground and signal contacts 116 are added to increase the dielectric constant of the materials disposed between the signal and ground contacts 116. For example, without the dielectric layers 300, the signal contact 116 may be separated from the ground contacts 116 only by air, which has a dielectric constant of approximately 1. With the dielectric layers 300, the signal contact 116 is separated from the ground contacts 116 by air and the dielectric layers 300. The dielectric layers 300 may have a dielectric constant that is greater than air. For example, the dielectric layers 300 may be formed from an epoxy having a dielectric constant between approximately 3.5 and 3.8, inclusive of 3.5 and 3.8. The increased dielectric constant of the materials (for example, air and the dielectric layers 300) that are located between the signal contact 116 and the ground contacts 116 may add electrical capacitance between the signal and ground contacts 116 and thereby reduce the electrical impedance characteristic of the signal contact 116.

One or more embodiments described herein provide a connector assembly that couples circuit boards in a parallel relationship and includes contacts that electrically join the circuit boards. The connector assembly includes a separation gap in the assembly and between the circuit boards. The portions of the contacts that are located in the separation gap may be individually coated with discrete, noncontinuous dielectric layers. The dielectric layers may reduce the cost of manufacturing the connector assembly as less dielectric material is used when compared to assemblies that include a continuous block of dielectric material that encloses the contacts. The dielectric layers may reduce thermal stresses in the connector assembly as the individual and discrete layers may expand and contract by smaller distances over a given change in temperature when compared to a continuous block of dielectric material. The dielectric layers may reduce the electrical impedance characteristic of signal contacts in the connector assembly by increasing the electrical capacitance between the signals contacts and nearest neighbor ground contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A mezzanine connector assembly configured to electrically interconnect first and second circuit boards, the connector assembly comprising:

a mounting body configured to be mounted to the first circuit board;

a mating body opposite of the mounting body and configured to mate with the second circuit board, the mating body separated from the mounting body by a separation gap along a vertical direction;

contacts extending between the mounting body and the mating body along the vertical direction, the contacts configured to be coupled with the first and second circuit boards to electrically join the first and second circuit boards; and dielectric layers comprising electrically insulative particles adhered to exterior surfaces of the contacts to discretely surround corresponding ones of the contacts in the separation gap between the mounting body and the mating body, wherein the dielectric layers are separated from one another by an air gap in the separation gap.

2. The connector assembly of claim 1, wherein the dielectric layers are separated from one another by the air gap in directions that are perpendicularly oriented with respect to the vertical direction.

3. The connector assembly of claim 1, wherein the contacts are discretely coated with the dielectric layers along lengths of the contacts that extend from the mounting body and the mating body.

4. The connector assembly of claim 1, wherein the dielectric layers are separate from one another between the mounting body and the mating body.

5. The connector assembly of claim 1, wherein the dielectric layers and the contacts are spaced apart to permit air to flow between the contacts and the dielectric layers in the separation gap between the mounting body and the mating body.

6. The connector assembly of claim 1, wherein the dielectric layers comprise electrically insulative films joined to exterior surfaces of the contacts.

7. The connector assembly of claim 1, wherein the dielectric layers are noncontinuous between the contacts.

8. The connector assembly of claim 1, wherein the contacts include protruding portions and gap portions, the protruding portions protruding from at least one of the mating body or mounting body, the gap portions disposed between the mating and mounting bodies, further wherein the dielectric layers enclose the gap portions and the protruding portions are exposed to electrically couple the contacts with at least one of the first or second circuit boards.

9. The connector assembly of claim 1, wherein the mounting body and the mating body are coupled with the first circuit board and the second circuit board to orient the first circuit board and the second circuit board in a parallel relationship.

10. The connector assembly of claim 1, wherein the dielectric layers include an epoxy material.

11. A connector assembly comprising: a mounting body configured to be mounted to a first circuit board;

a mating body opposite of the mounting body and configured to mate with a second circuit board to orient the first and second circuit boards in a parallel relationship and separated from one another by a separation gap;

contacts extending between the mounting body and the mating body, the contacts configured to electrically interconnect the first and second circuit boards; and dielectric layers including an epoxy material that circumferentially surrounds corresponding ones of the contacts in the separation gap between the mounting body and the mating body, wherein each of the contacts is individually coated with a corresponding one of the dielectric layers;

wherein the dialectic layers comprise electrically insulative particles joined to exterior surfaces of the contacts.

12. The connector assembly of claim 11, wherein the dielectric layers are separated from one another by an air gap in the separation gap between the mating body and the mounting body.

13. The connector assembly of claim 11, wherein the dielectric layers are separated from one another by the air gap in directions that are in parallel relationships with respect to the first and second circuit boards.

14. The connector assembly of claim 11, wherein the contacts are individually coated with the dielectric layers from the mounting body to the mating body.

15. The connector assembly of claim 11, wherein the dielectric layers are separated from one another from the mounting body to the mating body.

16. The connector assembly of claim 11, wherein the dielectric layers are separated from one another in the separation gap to permit air to flow between the contacts and the dielectric layers between the mounting body and the mating body.

17. The connector assembly of claim 11, wherein the dielectric layers comprise electrically insulative films adhered to exterior surfaces of the contacts.

18. The connector assembly of claim 11, wherein the dielectric layers are discrete layers separated from one another by an air gap.

19. The connector assembly of claim 11, wherein the dielectric layer of one of the contacts is separated from the dielectric layers of nearest neighbor ones of the contacts in the separation gap between the mounting body and the mating body.

* * * * *